United States Patent [19]

Nozaki et al.

[11] 4,189,997

[45] Feb. 26, 1980

[54] PRINTER

[75] Inventors: Mineo Nozaki; Mitsuaki Seki, both of Tokyo, Japan

[73] Assignee: Canon Kabushiki Kaisha, Tokyo, Japan

[21] Appl. No.: 914,721

[22] Filed: Jun. 12, 1978

Related U.S. Application Data

[63] Continuation of Ser. No. 757,287, Jan. 6, 1977, abandoned.

[30] Foreign Application Priority Data

Jan. 16, 1976 [JP] Japan ..... 51-3885

[51] Int. Cl.[2] ..... B41J 9/02

[52] U.S. Cl. ..... 101/93.09; 101/93.23; 101/93.29; 101/93.34; 101/93.48

[58] Field of Search ..... 101/93.02, 93.09, 93.29, 101/93.34, 93.48, 93.15; 335/199, 229; 400/144.2

[56] References Cited

U.S. PATENT DOCUMENTS

| | | | |
|---|---|---|---|
| Re. 26,240 | 7/1967 | Hasserman | 101/93.09 |
| 2,910,936 | 11/1959 | Christoff et al. | 101/93.02 |
| 3,049,990 | 8/1962 | Brown et al. | 101/93.34 |
| 3,195,453 | 7/1965 | Thiemann | 101/93.34 |
| 3,266,418 | 8/1966 | Russo | 101/93.02 |
| 3,437,885 | 4/1969 | Kussy et al. | 335/199 X |
| 3,453,572 | 7/1969 | Masterson | 101/93.48 X |
| 3,460,469 | 8/1969 | Brown et al. | 101/93.34 |
| 3,559,129 | 1/1971 | Quichard | 335/229 |
| 3,671,893 | 6/1972 | Edgar et al. | 335/229 X |
| 3,780,648 | 12/1973 | Curtisset al. | 101/93.02 |
| 3,924,528 | 12/1975 | Ludin | 101/93.15 |
| 3,985,218 | 10/1976 | Gerry | 400/144.2 X |

*Primary Examiner*—Edward M. Coven

*Attorney, Agent, or Firm*—Fitzpatrick, Cella, Harper & Scinto

[57] ABSTRACT

A printer has a stationary electromagnet device, a hammer having a permanent magnet therein, and a resilient member coupled to the hammer. The permanent magnet may be moved upon electrical energization of the electromagnet device to cause the hammer to impact against a character by mechanical energy accumulated in the resilient member.

11 Claims, 5 Drawing Figures

PRINTER

This is a continuation, of application Ser. No. 757,287 filed Jan. 6, 1977, now abandoned.

BACKGROUND OF THE INVENTION

1. Field of the Invention

This invention relates to a printer suitable for use with a compact desk-top calculator, and particularly to a very useful printer which permits great reduction in the number of components and accordingly can promise a lower cost, greater ease of assembly, much less probability of failure and stable repetitive operation and which eliminates the necessity of adjustment during the manufacture and later fine adjustment.

More particularly, the invention relates to a printer in which a permanent magnet is attached to a rockable printing hammer and a stationary electromagnet device is provided within the range of movement of the permanent magnet or the distribution of the magnetic field of the permanent magnet is expanded to the location where the stationary electromagnet device lies, so that the permanent magnet may be movable within said distribution of the magnetic field. Due to this construction during non-printing, the movable permanent magnet and a normally magnetic material in the electromagnet device attract each other to displace a resilient member coupled to the hammer head and thereby cause the resilient member to accumulate mechanical energy therein; and during printing, a current sufficient to negate at least the magnetic field of the permanent magnet may be supplied to the electromagnet to move the hammer to impact against a character wheel, whereafter the hammer may be quickly and automatically returned to its original position without the use of any special return mechanism.

2. Description of the Prior Art

Most of the heretofore known printers have been intended for use as the high-speed output devices of large electronic computers and have unavoidably been of complicated construction and large size. For example, there is known a printer of the type in which a shank is supported by a pair of plate springs studded perpendicularly to the axis of a character wheel and such shank is attracted by a first electromagnet and released upon operation of a second electromagnet device provided on the first electromagnet, thereby effecting printing. In such printer, however, a special cam mechanism must be provided to return the shank to its original position and this leads to the disadvantage of a complicated and expensive construction. The present invention eliminates such a special return mechanism and is constructed such that a permanent magnet is provided in the printing hammer portion against the conventional point of view to thereby enable the shank to automatically return to its original position and that the magnetic field of the permanent magnet covers the fixed electromagnet device. Also known is a printer in which a magnetic field generating device is provided in the hammer portion to enable use of Fleming's left-hand rule, but again in this type of printer, utilization is made of the coaction of the magnetic field resisting the spring force for returning the shank and therefore, the voltage and the quantity of current used must be considerably great so that the magnetic field generating device must be large in size. In addition, since the construction of this printer is based on the horizontal movement of the shank supported by the pair of plate springs studded perpendicularly to the axis of the character wheel, a space available for the hammer construction is required and this is not suitable for compact printer. Further, during the return of the shank, the repelling force of the shank and the return force of the pair of plate springs are added together to form a great magnitude of energy, which in turn makes it necessary to provide a buffer mechanism and a stop member. Also, adjustment of the stroke length is indispensable and this leads to difficulties in assembly.

The present invention enables realization of a construction in which the electromagnet device itself performs the function of the stop member and also of the buffer mechanism and in which the permanent magnet is accommodated within the hammer head to minimize the size of the printer and reduce the number of parts.

SUMMARY OF THE INVENTION

It is an object of the present invention to provide an improved compact printer which overcomes the disadvantages peculiar to the large printers of the prior art.

It is another object of the present invention to provide a compact printer which is suitable for use as the printer of a compact desk-top electronic calculator.

It is still another object of the present invention to provide a compact printer which only requires a low consumption of power and suffers less from malfunctioning and which uses a character drum suited to uniformize the quality of printing.

It is yet still another object of the present invention to provide a compact printer of the type which has a sufficient magnitude of energy for printing and yet is compact and in which a permanent magnet is movably accommodated within the hammer head so as to enable high-speed printing to be carried out.

It is a further object of the present invention to provide a printer which permits the printing hammer to return to its original position very quietly and quickly and automatically while permitting the printing energy to be accumulated up to a high level.

It is a further object of the present invention to provide a printer which requires a small number of parts and is compact and less expensive and which can perform high-speed printing and yet permits ready adjustment during manufacture.

It is a further object of the present invention to provide a printer in which the driving circuit, the number of hammers and other parts are economized to thereby enable a single hammer head to effect printing in a plurality of digits.

More particularly, it is an object of the present invention to provide a compact printer which has a permanent magnet in the hammer head portion and an electromagnet device fixedly disposed for each digit, whereby during non-printing, the permanent magnet and the magnetic material in the electromagnet device may attract each other to move the hammer head in non-printing direction; and during printing, the electromagnet device may be operated to effect printing by the use of mechanical energy accumulated in the printing hammer when it was attracted, whereafter upon deenergization of the electromagnet, the magnetic material in the electromagnet device and the permanent magnet may attract each other to thereby automatically return the printing hammer to its non-printing position.

It is also an object of the present invention to provide a compact printer in which the electromagnet device itself and an organic elastic member interposed between the electromagnet device and the permanent magnet have the functions of a stop and buffer during the return of the printing hammer, whereby the number of parts may be reduced to simplify the construction.

It is a further object of the present invention to provide a printer in which the spring constant of the printing hammer is variable to correspond to the attraction of the permanent magnet, whereby the printing energy may be effectively utilized to effect clear printing.

It is a further object of the present invention to provide a printer in which the printing hammer may be quickly returned to its original position after printing, thereby enabling two-impact printing (impact printing of the comma representing the unit of thousand or the decimal point and figures during one rotation period of the character drum).

It is a further object of the present invention to provide a printer in which a plurality of printing hammers are integrally formed with one another and a single common permanent magnet is provided within the head of the printing hammers, thereby further reducing the number of parts.

In an embodiment of the present invention, the printing energy is accumulated by the hammer head being biased due to the attraction between the permanent magnet and the magnetic material in the electromagnet device. The force with which the hammer head is biased and restrained is caused to act at all times irrespective of the printing or non-printing condition.

To release the hammer head from such restraint, a voltage is supplied to the electromagnet device comprising a coil wound on an iron core which is a magnetic material, whereby a counter magnetic field is generated in the iron core in a direction to negate the sense of the magnetic flux from the permanent magnet which has passed through the iron core, and the printing hammer is caused to impact against the character drum by the energy so far accumulated in the plate spring, thus accomplishing printing. In this case, the voltage applied may of course be of such a high value as to generate a counter magnetic field of opposite sense with respect to that of the permanent magnet. The time during which the voltage is supplied to the coil may preferably continue until immediately before the printing hammer contacts the character drum. The reason is that since a permanent magnetic field is generated at all times by the permanent magnet, it is necessary to generate a counter magnetic field in the iron core by supplying the voltage to the coil as long as the printing hammer is moved, and any slight excess of the voltage supply time beyond the time of impact contact between the printing hammer and the character drum would undesirably cause disturbance in the style of the printed characters because the character drum is in rapid rotation.

Therefore, clear printing may be achieved if the construction is designed such that once the voltage supply is discontinued immediately before printing, the contact of the printing hammer with the character drum may be accomplished by the inertia force of the hammer and most of the accumulated energy may be converted into printing energy, whereafter the hammer head may again be returned to its original position by the attraction of the permanent magnet.

The spring may be of any material and shape which will permit the spring to be biased by the attraction of the permanent magnet to thereby accumulate a sufficient stroke and energy to effect printing and will also have a bias force capable of fully releasing the energy.

Also, if the hammer head portion accommodating therein the permanent magnet of the printing hammer is shaped by molding plastics or like material so as to minimize the noise of impact, quiet printing may be achieved and the permanent magnet may be protected against deterioration of its magnetic characteristic.

The above objects and features of the present invention will become more fully apparent from the following detailed description of some embodiments of the invention taken in conjunction with the accompanying drawings.

DESCRIPTION OF THE PREFERRED EMBODIMENTS

Figure 1:
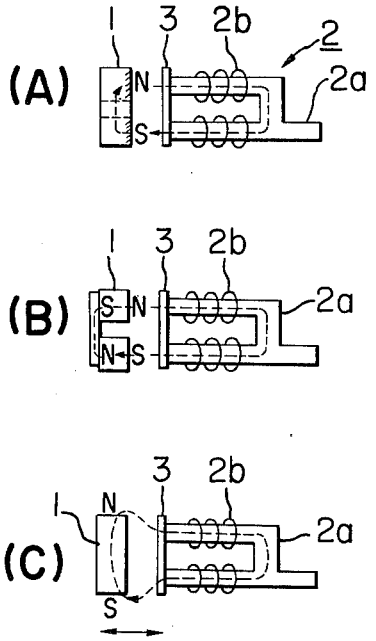
FIG. 1 is a schematic view illustrating the principle of the present invention.

Referring to FIG. 1 which illustrates the principle of the present invention, a permanent magnet 1 is provided on a hammer head portion and an electromagnet device 2 is secured behind the hammer. Hammer driving energy may be accumulated in a hammer spring and released under the control of the electromagnet device 2, thus driving the hammer.

FIG. 1(A) shows an example in which the movable permanent magnet 1 is provided with poles on the surface thereof which is opposed to the stationary electromagnet device 2, FIG. 1(C) shows an example in which the permanent magnet is provided with poles on the upper and lower surfaces thereof, and FIG. 1(B) shows an example in which two permanent magnets are provided in the manner as shown. The stationary electromagnet device 2 comprises chiefly a pole piece 2*a* and a coil 2*b*, and the movable permanent magnet may be moved by controlling the voltage supply to the coil 2*b*. More specifically, as shown in FIG. 2(A), the permanent magnet 1 is cast into the head portion 4*a* of an L-shaped hammer 4 formed of plastics or like material, the L-shaped hammer is pivotally supported by a fulcrum shaft 5, and one end of a spring 6 is secured to the other end of the hammer while the other end of the spring 6 is secured to the pole piece 2*a*.

In such state, attraction acts on the permanent magnet 1 and the pole piece 2*a* so that the magnet 1 is normally in contact with a damper sheet 3 of Teflon or like material, thus being stationary, and by the permanent magnet being so attracted, the spring 6 is elongated to accumulate therein mechanical energy for moving the hammer. When the voltage is now supplied to the coil 2*b*, there is produced in the coil a counter magnetic field opposing the magnet 1, so that the attraction between the magnet 1 and the electromagnet 2 becomes null or repelling force is created therebetween. Accordingly, as shown in FIG. 2(B), the energy of the spring 6 is released to cause the head portion 4*a* to impact against a character wheel 10 and thereby effect printing.

Figure 2:
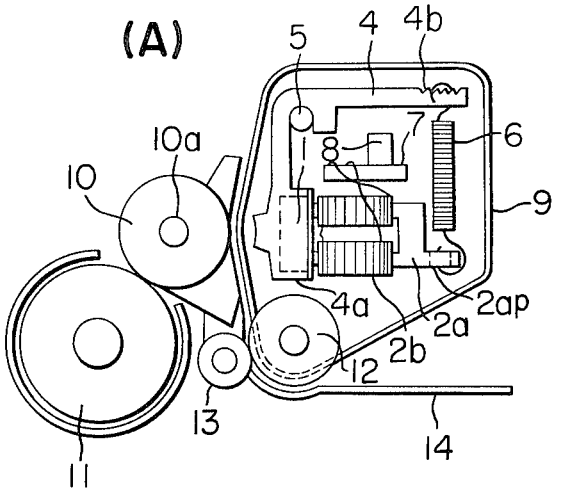
FIG. 2 is a side elevational view illustrating a specific embodiment of the present invention.
Figure 2:
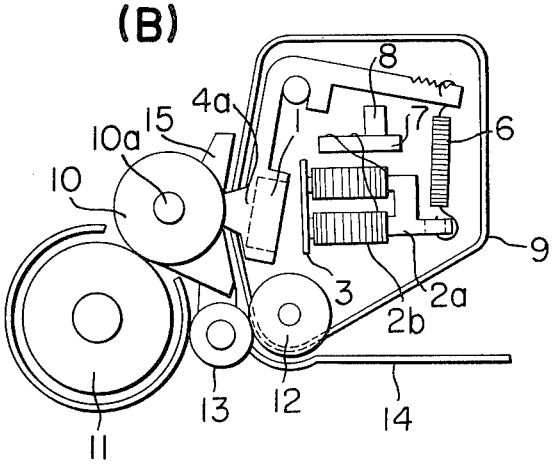

The voltage supply is discontinued, whereupon the above-described force relationship is restored and as shown in FIG. 2(A), the permanent magnet 1 becomes attracted to the electromagnet 2 to thereby cause the spring 6 to accumulate energy, thus becoming ready for another printing. Designated by 7 is a printed plate on which a control circuit section 8 rests, and 9 denotes a guide having a window formed in the portion thereof which corresponds to the head portion 4*a*.

The character wheel 10 is formed of an organic elastic material such as rubber or the like. Reference numeral 11 designates an ink roller, 12 a paper feed roller, 13 a pinch roller, 14 a paper feed guide and 15 a plate for preventing paper from being contaminated by ink. It is apparent that the construction described above permits easier loading of paper than the printer of the type which uses the conventional ink roller.

Figure 3:
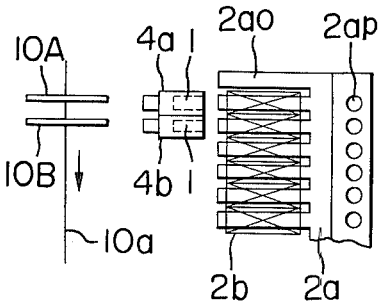
FIG. 3 is a plan schematic view thereof.

FIG. 3 is a plan view illustrating the manner in which a plurality of digits are impacted by a single hammer. The end 2aO of the pole piece is provided to uniformize the distribution of magnetic field and ensure uniform movement of the hammer for each digit. In the shown position, the character wheels 10A, 10B may be impacted by the hammers 4*a*, 4*b* to print odd-number digits, for example, and then the character wheels 10A, 10B may be moved in the direction of arrow and if again impacted by the hammers 4*a*, 4*b*, even-number digits may be printed. Thus, the hammers 4*a*, 4*b* function to print two digits each, and this means a much simplified mechanism.

In an embodiment, the permanent magnet 1 may be a super-high performance magnet such as an alloy of rare earth and cobalt and this will mean that minimum necessary energy for driving the hammer may be provided by an ultra-compact permanent magnet, which will also be very suitable to form a compact printer. Further, the use of a common permanent magnet for a plurality of digits necessarily leads to a greater intensity of magnetic field and this conveniently overcomes the disadvantage that the use of individual permanent magnets for individual digits suffers from a lower intensity of magnetic field which is insufficient to provide a sufficient magnitude of printing energy.

The damper 3 is suited to alleviate the mechanical shocks imparted to the permanent magnet 1 and thereby protect it against deterioration. Of course, the damper also effectively functions to prevent break of the coil 2*b*. As can be seen from FIGS. 1, 2(A) and 2(B), the damper 3 is disposed so that the magnetic material 2*a* is spaced from a surface of the permanent magnet 1 wherein the magnetic field is at its maximum. Thus, it will be appreciated that this arrangement permits the minimization of the power required for releasing the hammer.

Figure 4:
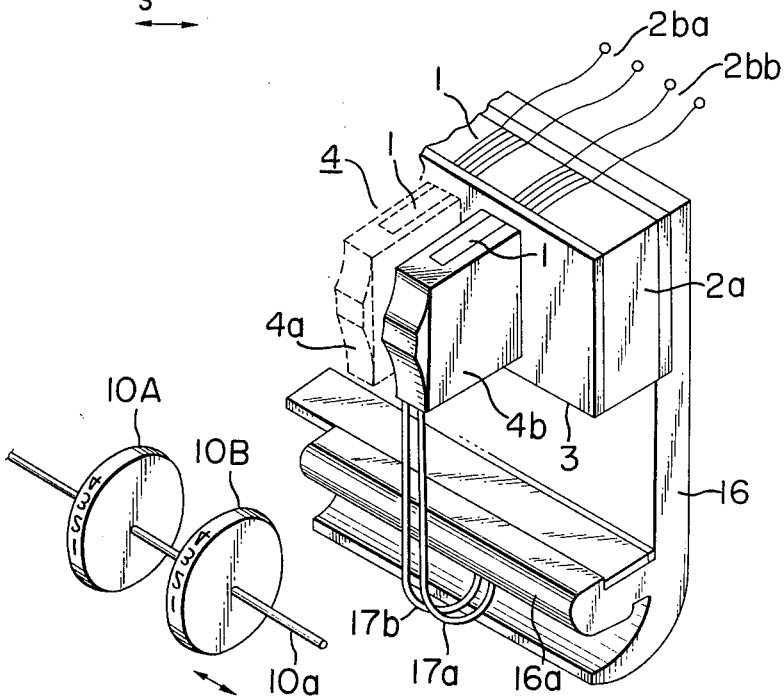
FIG. 4 is a perspective view illustrating another embodiment of the present invention.
Figure 5:
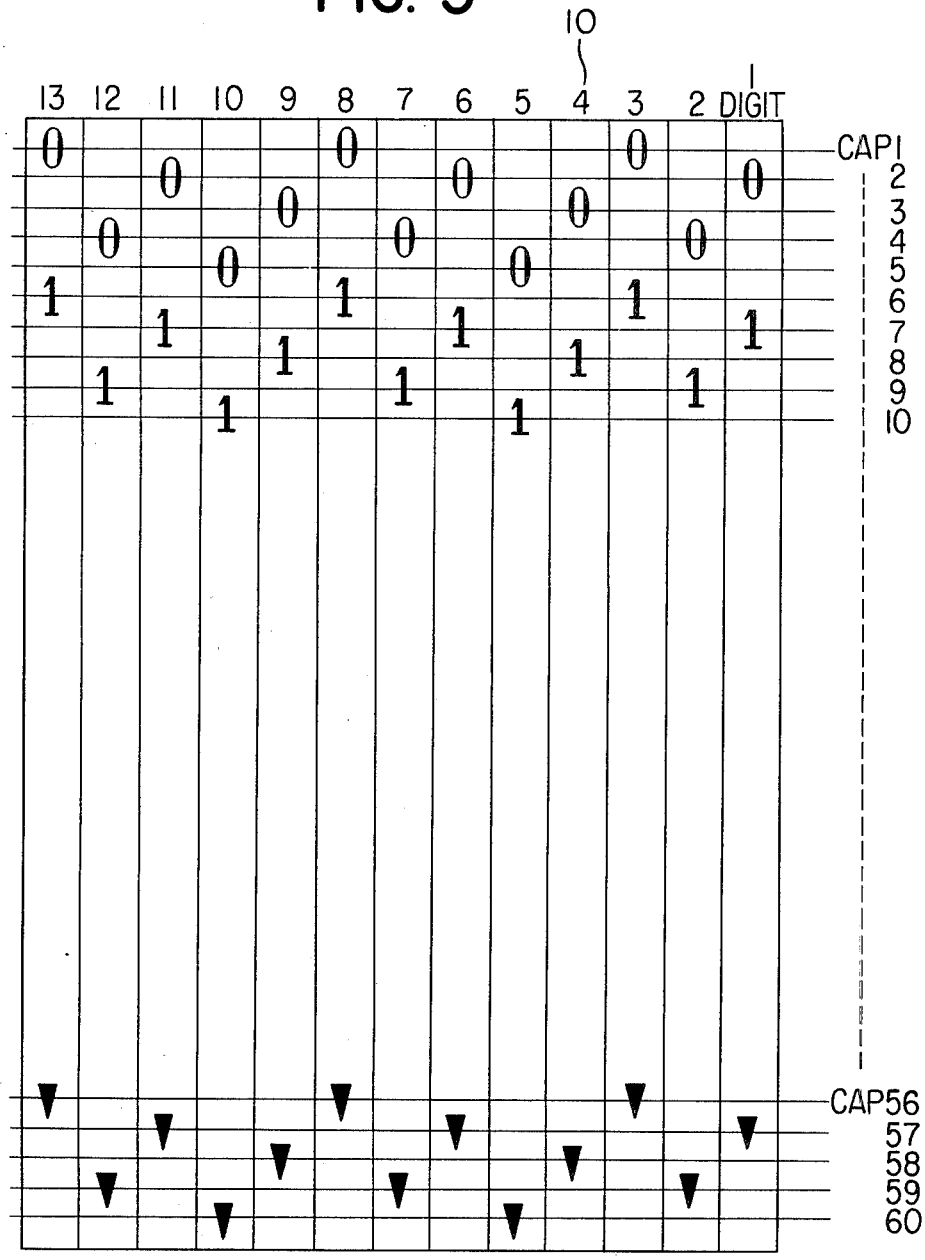
FIG. 5 shows an example of the character wheel used with the present invention.

FIG. 4 shows another embodiment of the present invention. A hammer head 4*b* or other is supported by springs 17*a*, 17*b* and the permanent magnet 1 within the head is attracted by the common iron core 2*a* in the electromagnet 2*bb* so that the head 4*b* is moved backwardly to bear against the damper 3. Because of such bias, mechanical energy for printing is accumulated in the springs 17*a*, 17*b*. The spring constant of these springs may be adjusted by modifying the shape of the bent portion 16*a* of a base plate 16 so as to optimally adjust the stroke, printing pressure, etc. Again in this embodiment, the hammer head has a sufficient width to print a plurality of digits, and the character wheels 10A, 10B may be disposed for every two digits, for example, so that they may be shifted to right or left by an amount corresponding to one digit. Alternatively, the characters may be arranged in staggered relationship as shown in FIG. 5, thereby obtaining the same effect as noted above. In this latter case, the right and left shift mechanism for the character wheels may be eliminated, thus further simplifying the construction of the printer.

What we claim is:

1. A printer comprising:

a type member including a plurality of type characters, said type member comprising a non-magnetic material;

ink supplying means for supplying ink to said type member;

a hammer head arranged to move against selected ones of the plurality of type characters, said hammer head consisting of non-magnetic material;

an elastic member connected to said hammer head at one end and to a base plate at the other end, said elastic member biasing said hammer head toward a printing position;

magnetic field producing means comprising a permanent magnet mounted in said printing hammer head to hold said hammer head at a non-printing position in such a way that the permanent magnet contacts with a magnetic material disposed at the non-printing position whereby mechanical energy is stored in said elastic member; and an electromagnetic assembly disposed at the non-printing position for producing a magnetic field opposed to the magnetic flux of said permanent magnet when selectively actuated so that the mechanical energy stored in said elastic member is released to move said hammer head in the direction towards its printing position.

2. A printer according to claim 1, wherein said permanent magnet includes rare earth.

3. A printer according to claim 1, wherein the plurality of types on said type member are arranged in rows of types of like kind, said types of like kind being spaced apart from one another and shifted in position with respect to the types in the next adjacent row.

4. A printer according to claim 1, wherein said electromagnet assembly is of magnetic material and of U-shape of which the edge portion of each leg is disposed opposite a north pole and a south pole of said permanent magnet, respectively.

5. A printer comprising:

a type member including a plurality of type characters, said type member comprising a non-magnetic material;

ink supplying means for supplying ink to said type member;

a hammer head arranged to move against selected ones of the plurality of type characters, said hammer head consisting of non-magnetic material;

an elastic member connected to said hammer head at one end and to a base plate at the other end, said elastic member biasing said hammer head toward a printing position;

magnetic field producing means comprising a permanent magnet mounted in said printing hammer head to hold said hammer head at a non-printing position in such a way that the permanent magnet contacts with a magnetic material disposed at the non-printing position whereby mechanical energy is stored in said elastic member;

an electromagnet assembly disposed at the non-printing position for producing a magnetic field opposed to the magnetic flux of said permanent magnet when selectively actuated so that the mechanical energy stored in said elastic member is released to move said hammer head in the direction towards its printing position; and a non-magnetic member disposed between said permanent magnet and said electromagnet assembly, whereby said electromagnet assembly is spaced from a plane defining the strongest magnetic field of said permanent magnet by the thickness of said non-magnetic member.

6. A printer according to claim 5, wherein the plurality of types on said type member are arranged in rows of types of like kind, said types of like kind being spaced apart from one another and shifted in position with respect to the types in the next adjacent row.

7. A printer according to claim 5, wherein said electromagnet assembly is of magnetic material and of U-shape of which the edge portion of each leg is disposed opposite a north pole and a south pole of said permanent magnet, respectively.

8. A printer according to claim 5, wherein said permanent magnet includes rare earth.

9. A printer comprising:

a type member including a plurality of type characters, said type member comprising a non-magnetic material;

ink supplying means for supplying ink to said type member;

a hammer head arranged to move against selected ones of the plurality of type characters, said hammer head consisting of non-magnetic material;

an elastic member connected to said hammer head at one end and to a base plate at the other end, said elastic member biasing said hammer head toward a printing position;

magnetic field producing means comprising a permanent magnet mounted in said printing hammer head to hold said hammer head at a non-printing position in such a way that the permanent magnet contacts with a magnetic material disposed at the non-printing position whereby mechanical energy is stored in said elastic member, said magnetic field producing means emitting a magnetic flux from a first portion of said permanent magnet and absorbing the magnetic flux at a second portion of said permanent magnet to establish a first magnetic field; and an electromagnet assembly disposed at the non-printing position for producing a second magnetic field opposed to the first magnetic field of said permanent magnet when selectively actuated so that the mechanical energy stored in said elastic member is released to move said hammer head in the direction towards its printing position, said electromagnetic assembly including a magnetic member having a pair of projections and a coil wound on said magnetic member, said pair of projections being disposed opposite the first and second portions of said permanent magnet, respectively; and a non-magnetic member disposed between said permanent magnet and said electromagnet assembly whereby said electromagnet assembly is spaced from a plane defining the strongest magnetic field of said permanent magnet by the thickness of said non-magnetic member.

10. A printer according to claim 9, wherein said permanent magnet includes rare earth.

11. A printer according to claim 9, wherein the plurality of types on said type member are arranged in rows of types of like kind, said types of like kind being spaced apart from one another and shifted in position with respect to the types in the next adjacent row.

* * * * *